US011673394B2

(12) United States Patent
Hoang

(10) Patent No.: US 11,673,394 B2
(45) Date of Patent: Jun. 13, 2023

(54) PRINTING APPARATUS AND PRINTING CONTROL METHOD

(71) Applicant: SEIKO EPSON CORPORATION, Tokyo (JP)

(72) Inventor: Duc Hoang, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/645,333

(22) Filed: Dec. 21, 2021

(65) Prior Publication Data

US 2022/0212472 A1 Jul. 7, 2022

(30) Foreign Application Priority Data

Dec. 24, 2020 (JP) ..... JP2020-215378

(51) Int. Cl.
*B41J 2/165* (2006.01)

(52) U.S. Cl.
CPC .... *B41J 2/1652* (2013.01); *B41J 2002/16573* (2013.01)

(58) Field of Classification Search
CPC ..... B41J 2/1652; B41J 2002/16573
See application file for complete search history.

(56) References Cited

U.S. PATENT DOCUMENTS 6,345,878 B1 2/2002 Kanaya
2015/0231886 A1 8/2015 Yamazaki et al.

FOREIGN PATENT DOCUMENTS

JP 2000-158673 A 6/2000
JP 4305034 B2 * 7/2009
JP 2015-150869 A 8/2015

* cited by examiner

*Primary Examiner* — Sharon Polk
(74) *Attorney, Agent, or Firm* — Workman Nydegger

(57) ABSTRACT

A printing apparatus includes: a flushing determination unit, and a storage unit, wherein the flushing determination unit is configured to: calculate a temporary return position, a temporary reciprocating movement time that is necessary when the carriage is returned at the temporary return position, and a threshold value that is a longest non-ejection time during which printing can be performed in a stable manner at an environmental temperature measured by a thermometer, based on print data to be printed in reciprocating movement of the carriage; and determine whether the temporary reciprocating movement time exceeds the threshold value, wherein when the temporary reciprocating movement time exceeds the threshold value, the flushing determination unit sets a position at which the one reciprocating movement time becomes longer than the temporary reciprocating movement time as a return position in the reciprocating movement, and determines to perform the flushing in a return path.

8 Claims, 8 Drawing Sheets

PRINTING APPARATUS AND PRINTING CONTROL METHOD

The present application is based on, and claims priority from JP Application Serial Number 2020-215378, filed Dec. 24, 2020, the disclosure of which is hereby incorporated by reference herein in its entirety.

BACKGROUND

1. Technical Field

The present disclosure relates to a printing apparatus and a printing control method.

2. Related Art

In the related art, there has been used an ink jet-type printing apparatus configured to print an image or the like on a medium such as a paper or a fabric by ejecting a liquid such as ink from an ejection head having nozzles toward a surface 23*a* of the medium. Such a printing apparatus is provided with a maintenance unit that is configured to perform maintenance of the ejection head in order to prevent ejection failure of ink from the nozzles.

In case of producing a printed object, a quality of an image must be stable at any position on a printing medium. In a printing apparatus configured to perform printing by ejecting ink from nozzles, in a nozzle that does not eject ink for a certain period of time or longer, moisture is evaporated from a nozzle tip so that a viscosity of the ink is increased whereby the nozzle is brought into a clogged state. Accordingly, there is a concern that the ink cannot be ejected normally from the nozzle having a low ink ejection frequency, and a quality of printing is lowered.

A state where ink cannot be ejected normally includes a phenomenon that a landing error exceeds an allowable value although ink can be ejected. There is a tendency that the longer a period during which ink is not ejected from the nozzle, the larger the landing error becomes. Accordingly, in the maintenance unit in the printing apparatus, the clogging of the nozzle is prevented or eliminated by performing a flushing operation in which ink is ejected toward an ink receiving portion separately from printing. The printing apparatus disclosed in JP-A-2000-158673 includes an ink receiving portion configured to receive ink at the time of performing a flushing operation on both a home side and a full digit side. To improve throughput, there has been disclosed a technique for determining whether to perform a flushing operation corresponding to a paper width, a moving direction of a carriage at the time of starting printing, a wait time between passes, and the like.

However, particularly when a moving time of the carriage is elongated in a large size printing apparatus, there is a problem that a standing time of a nozzle from which ink is not ejected is elongated so that stability in landing of the ink is lowered in the latter half of the forward path and the return path succeeding to the forward path.

SUMMARY

According to an aspect of the present disclosure, there is provided a printing apparatus including: an ink jet-type recording head configured to eject a droplet from a nozzle to a printing medium, a carriage configured to reciprocate in a first direction while supporting the recording head, a thermometer configured to measure an environmental temperature in a vicinity of the nozzle, a control unit configured to control reciprocating movement of the carriage and ejection of the droplet from the nozzle, a flushing determination unit configured to determine whether to perform flushing in a return path of the reciprocating movement of the carriage, and a storage unit configured to store a condition for a landing error of the droplet ejected from the nozzle to be equal to or less than a predetermined allowable value based on a preliminarily obtained correspondence relationship between a non-ejection time that is a time during which the droplet is not ejected from the nozzle and a temperature, wherein the flushing determination unit is configured to: calculate, in one reciprocating movement of the carriage, based on print data to be printed in the one reciprocating movement, a temporary return position in the reciprocating movement, a temporary reciprocating movement time that is a one reciprocating movement time of the carriage necessary when the carriage is returned at the temporary return position, and a threshold value that is a longest non-ejection time that satisfies the condition at the environmental temperature measured by the thermometer, and determine whether the temporary reciprocating movement time exceeds the threshold value, wherein when the temporary reciprocating movement time exceeds the threshold value, the flushing determination unit sets a position at which the one reciprocating movement time becomes longer than the temporary reciprocating movement time as a return position in the reciprocating movement of the carriage, and determines to perform the flushing in the return path of the movement of the carriage.

According to another aspect of the present disclosure, there is provided a printing control method of a printing apparatus that includes: an ink jet-type recording head configured to eject a droplet from a nozzle to a printing medium, a carriage configured to reciprocate in a first direction while supporting the recording head, a thermometer configured to measure an environmental temperature in a vicinity of the nozzle, and a control unit configured to control the reciprocating movement of the carriage and ejection of the droplet from the nozzle, the printing control method comprising: determining whether to perform flushing in a return path of the reciprocating movement of the carriage, and storing a condition for a landing error of the droplet ejected from the nozzle to be equal to or less than a predetermined allowable value based on a preliminarily obtained correspondence relationship between a non-ejection time that is a time during which the droplet is not ejected from the nozzle and a temperature, wherein in the determining, in one reciprocating movement of the carriage, based on print data to be printed in the one reciprocating movement, a temporary return position in the reciprocating movement of the carriage, a temporary reciprocating movement time that is the one reciprocating movement time of the carriage necessary when the carriage is returned at the temporary return position, and a threshold value that is a longest non-ejection time that satisfies the condition at the environmental temperature measured by the thermometer are calculated, and whether the temporarily reciprocating movement time exceeds the threshold value is determined, when the temporarily reciprocating movement time exceeds the threshold value, a position at which the one reciprocating movement time becomes longer than the temporary reciprocating movement time is set as a return position in the reciprocating movement of the carriage, and performing flushing in the return path of the movement of the carriage is decided.

DESCRIPTION OF EXEMPLARY EMBODIMENTS

Figure 1:
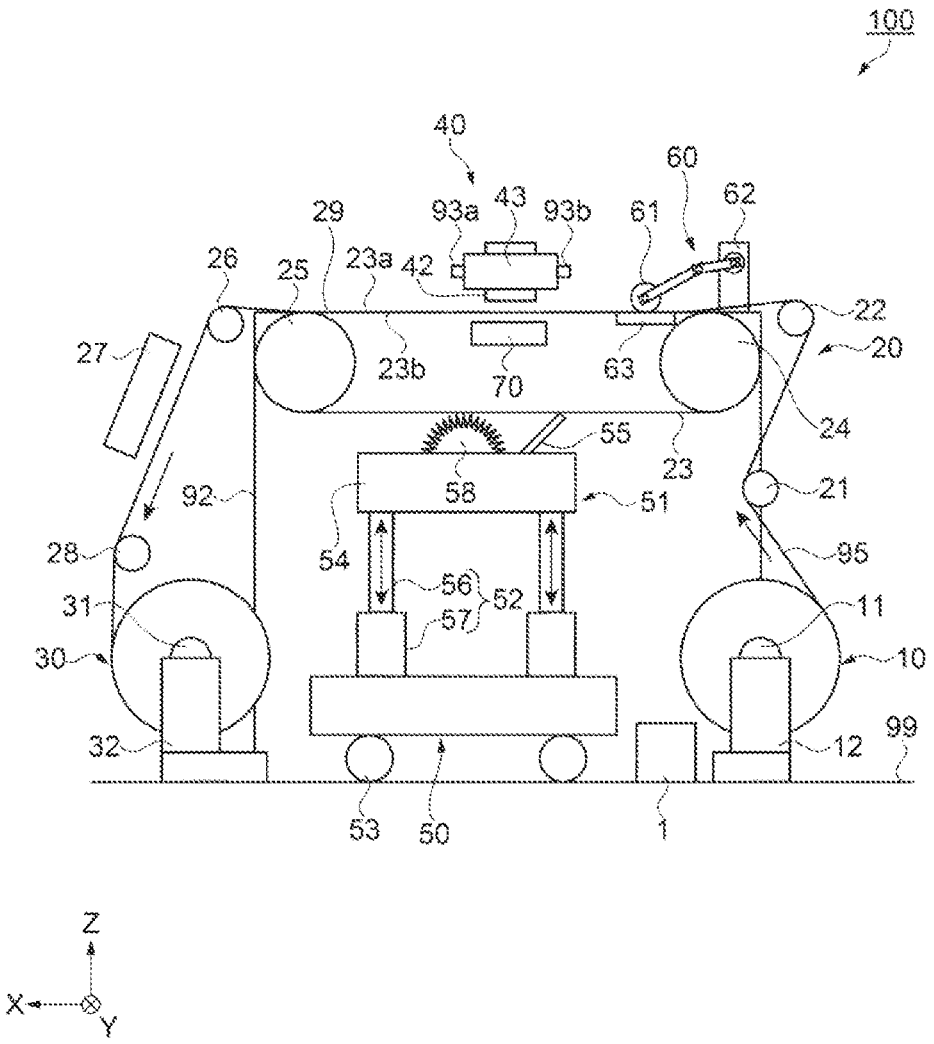
FIG. 1 is a schematic view illustrating a schematic overall configuration of a printing apparatus according to an embodiment.

Hereinafter, embodiments of the present disclosure are described with reference to attached drawings.

FIG. 1 to FIG. 8 illustrate an example of a mode for carrying out the disclosure, and in FIG. 1 to FIG. 8, parts given the same symbols are identical with each other. Here, in the respective drawings, some configurations are omitted when appropriate, and the drawings are illustrated in a simplified manner. Further, sizes, shapes, thicknesses, and the like of members are expressed in an exaggerated manner when appropriate.

Further, in the drawings, for the sake of convenience of the description, an X axis, a Y axis, and a Z axis are defined as three axes orthogonal to each other, and a distal end side of an arrow indicating an axial direction is assumed as a "+ side" and a proximal end side is assumed as a "– side". Further, hereinafter, a direction parallel to the X axis is referred to as an "X axis direction", a direction parallel to the Y axis is referred to as a "Y axis direction", and a direction parallel to the Z axis is referred to as a "Z axis direction".

FIG. 1 is a schematic view illustrating a schematic overall configuration of a printing apparatus 100 according to an embodiment of the present disclosure. In the present embodiment, the description is made by taking the ink jet-type printing apparatus 100 configured to perform fabric printing on a printing medium 95 by forming an image or the like on the printing medium 95, as an example.

The printing apparatus 100 includes a medium supply unit 10, a medium transport unit 20, a medium collecting unit 30, a printing unit 40, a cleaning unit 50, a medium close contact unit 60, and the like. Further, the printing apparatus 100 includes a control unit 1 configured to control the whole printing apparatus 100.

The control unit 1 is constituted of a CPU, a RAM, a ROM, and the like, and is configured to perform various controls. The CPU is a so-called central processing unit, and is configured to execute various programs thus realizing various functions. The RAM is used as a work region and a storage region for the CPU, and the ROM is configured to store operating systems and programs executed by the CPU.

The respective units of the printing apparatus 100 are attached to a frame portion 92.

The medium supply unit 10 is configured to supply the printing medium 95 on which an image is to be formed to a printing unit 40 side. As the printing medium 95, a fabric such as cotton, wool, chemical fiber, a mixture of these materials, or the like is used. The medium supply unit 10 includes a feeding shaft portion 11 and a bearing portion 12. The supply shaft portion 11 is formed in a circular cylindrical shape or a circular columnar shape, and is provided rotatably in a circumferential direction. The medium 95 having a strip shape is wound around the supply shaft portion 11 in a roll shape. The supply shaft portion 11 is detachably attached to the bearing portion 12. With such a configuration, the printing medium 95 being wound around the supply shaft portion 11 is attached to the bearing portion 12 together with the supply shaft portion 11.

The bearing portion 12 supports both ends in an axial direction of the supply shaft portion 11 in a rotatable manner. The medium supply unit 10 includes a rotary driving portion configured to rotate and drive the supply shaft portion 11. The rotary driving portion is configured to rotate the supply shaft portion 11 in a direction that the printing medium 95 is fed. An operation of the rotary driving portion is controlled by the control unit 1.

The medium transport unit 20 is configured to transport the printing medium 95 from the medium supply unit 10 to the medium collecting unit 30. The medium transport unit 20 includes a transport roller 21, a transport roller 22, a belt 23, a belt rotating roller 24, a belt driving roller 25, a transport roller 26, a drying unit 27, and a transport roller 28. The transport rollers 21, 22 are configured to relay the printing medium 95 from the medium supply unit 10 to the belt 23.

The belt 23 is formed in an annular shape obtained by coupling both end portions of a strip-shaped belt, and is extended between and wound around the belt rotating roller 24 and the belt driving roller 25. The belt 23 is held in a state where predetermined tension acts on the belt 23 such that a portion of the belt 23 between the belt rotating roller 24 and the belt driving roller 25 is disposed parallel to a floor surface 99. On a front surface 23*a* of the belt 23, an adhesive layer 29 for allowing the printing medium 95 to be adhered to the belt 23 is provided. The belt 23 is configured to support the printing medium 95 that is supplied from the transport roller 22 and is brought into close contact with the adhesive layer 29 by the medium close contact unit 60 described later. With such a configuration, a fabric having stretchability, or the like can be used as the printing medium 95.

The belt rotating roller 24 and the belt driving roller 25 are configured to support an inner peripheral surface 23*b* of the belt 23. Here, a configuration may also be adopted where a support portion configured to support the belt 23 is provided between the belt rotating roller 24 and the belt driving roller 25.

The belt driving roller 25 includes a motor configured to rotate and drive the belt driving roller 25. When the belt driving roller 25 is rotated and driven, the belt 23 rotates along with the rotation of the belt driving roller 25, and the belt rotating roller 24 rotates due to the rotation of the belt 23. Due to the rotation of the belt 23, the printing medium 95 supported by the belt 23 is transported in a predetermined +X axis direction, and an image is formed on the printing medium 95, in the printing unit 40 described later.

In the present embodiment, the printing medium 95 is supported by the front surface 23*a* of the belt 23, on a +Z axis side where the surface 23*a* faces the printing unit 40, and the printing medium 95 is transported from a belt rotating roller 24 side to a belt driving roller 25 side together with the belt 23. Further, on a −Z axis side where the front surface 23*a* of the belt 23 faces the cleaning unit 50, only the belt 23 moves from the belt driving roller 25 side to the belt rotating roller 24 side.

The transport roller 26 is configured to peel off the printing medium 95 on which an image is formed from the adhesive layer 29 of the belt 23. The transport rollers 26, 28 are configured to relay the printing medium 95 from the belt 23 to the medium collecting unit 30.

The medium collecting unit 30 is configured to collect the printing medium 95 transported by the medium transport unit 20. The medium collecting unit 30 includes a winding shaft portion 31 and a bearing portion 32. The winding shaft portion 31 is formed in a circular cylindrical shape or a circular columnar shape, and is provided rotatably in a circumferential direction. The printing medium 95 having the strip shape is wound around the winding shaft portion 31 in a roll shape. The winding shaft portion 31 is detachably attached to the bearing portion 32. With such a configuration, the printing medium 95 being wound around the winding shaft portion 31 can be removed together with the winding shaft portion 31.

The bearing portion 32 supports both ends in an axial direction of the winding shaft portion 31 in a rotatable manner. The medium collecting unit 30 includes a rotary driving portion configured to rotate and drive the winding shaft portion 31. The rotary driving portion is configured to rotate the winding shaft portion 31 in a direction that the printing medium 95 is wound. An operation of the rotary driving portion is controlled by the control unit 1.

In the present embodiment, the drying unit 27 is disposed between the transport roller 26 and the transport roller 28. The drying unit 27 is provided for drying an image formed on the printing medium 95. The drying unit 27 includes an IR heater, for example, and is configured to dry an image formed on the printing medium 95 in a short time by driving the IR heater. With such a configuration, the printing medium 95 having a strip shape on which an image is formed can be wound around the winding shaft portion 31.

The medium close contact unit 60 is configured to bring the printing medium 95 into close contact with the belt 23. The medium close contact unit 60 is disposed upstream of, that is, on a −X axis side of the printing unit 40 in the transport direction of the printing medium 95. The medium close contact unit 60 includes a press roller 61, a press roller driving portion 62, and a roller support portion 63. The press roller 61 is formed in a circular cylindrical shape or a circular columnar shape, and is provided rotatably in a circumferential direction. The press roller 61 is disposed such that an axial direction of the press roller 61 intersects with the transport direction so as to rotate in a direction along the transport direction. The roller support portion 63 is provided on an inner peripheral surface 23*b* side of the belt 23 where the roller support portion 63 faces the press roller 61 with the belt 23 sandwiched therebetween.

The press roller driving portion 62 is configured to move the press roller 61 in the transport direction, that is, the +X axis direction and in the −X axis direction opposite to the transport direction while pressing the press roller 61 toward a −Z axis side in a vertical direction. The printing medium 95 that is transported from the transport roller 22 and is superimposed on the belt 23 is pressed to the belt 23 between the press roller 61 and the roller support portion 63. With such a configuration, it is possible to cause the printing medium 95 to adhere to the adhesive layer 29 provided on the front surface 23*a* of the belt 23 with certainty, and it is possible to prevent the occurrence of floating of the printing medium 95 from the belt 23.

The printing apparatus 100 includes a cleaning unit 50 for cleaning the belt 23. Specifically, the cleaning unit 50 is constituted of a cleaning portion 51, a pressing portion 52, and a moving portion 53. The moving portion 53 is configured to fix the cleaning unit 50 to a predetermined position by moving the cleaning unit 50 in an integrated manner along the floor surface 99. The cleaning unit 50 is disposed between the belt rotating roller 24 and the belt driving roller 25 in the X axis direction.

The pressing portion 52 is a lifting device constituted of an air cylinder 56 and a ball bush 57, for example, and is configured to move the cleaning portion 51 provided above the pressing portion 52 between a cleaning position and a retracted position. The cleaning position is a position where a cleaning roller 58 and a blade 55 come into contact with the belt 23. The retracted position is a position where the cleaning roller 58 and the blade 55 are separated from the belt 23. The cleaning portion 51 cleans, at the cleaning position, the front surface 23*a* of the belt 23 that is extended between and wound around the belt rotating roller 24 and the belt driving roller 25 in a state where a predetermined tension is applied to the belt 23. The cleaning portion 51 cleans the front surface 23*a* from the −Z axis direction side. Here, FIG. 1 illustrates a case where the cleaning portion 51 is lifted and disposed at the cleaning position.

The cleaning portion 51 includes a cleaning tank 54, the cleaning roller 58, and the blade 55. The cleaning tank 54 is a tank configured to store a cleaning liquid used for cleaning the front surface 23*a* of the belt 23 to which ink and foreign materials are stuck, and the cleaning roller 58 and the blade 55 are provided inside the cleaning tank 54. As the cleaning liquid, for example, water or a water soluble solvent such as an alcohol can be used, and a surfactant or an anti-foaming agent may be added to the cleaning liquid when necessary.

A −Z axis side of the cleaning roller 58 is immersed in the cleaning liquid stored in the cleaning tank 54. When the cleaning roller 58 rotates at the cleaning position, the cleaning liquid is supplied to the front surface 23*a* of the belt 23 and, at the same time, the cleaning roller 58 and the belt 23 slide against each other. Due to such an operation, ink, fibers of a fabric as the printing medium 95, and the like sticking to the belt 23 are removed by the cleaning roller 58.

For example, the blade 55 can be formed of a flexible material such as silicon rubber. The blade 55 is provided on a downstream side of the cleaning roller 58 in the transport direction of the belt 23. The belt 23 and the blade 55 slide against each other and hence, the cleaning liquid remaining on the front surface 23*a* of the belt 23 is removed.

The printing unit 40 is configured to eject ink as a liquid toward the printing medium 95 held by the belt 23 in the form of a droplet.

Figure 2:
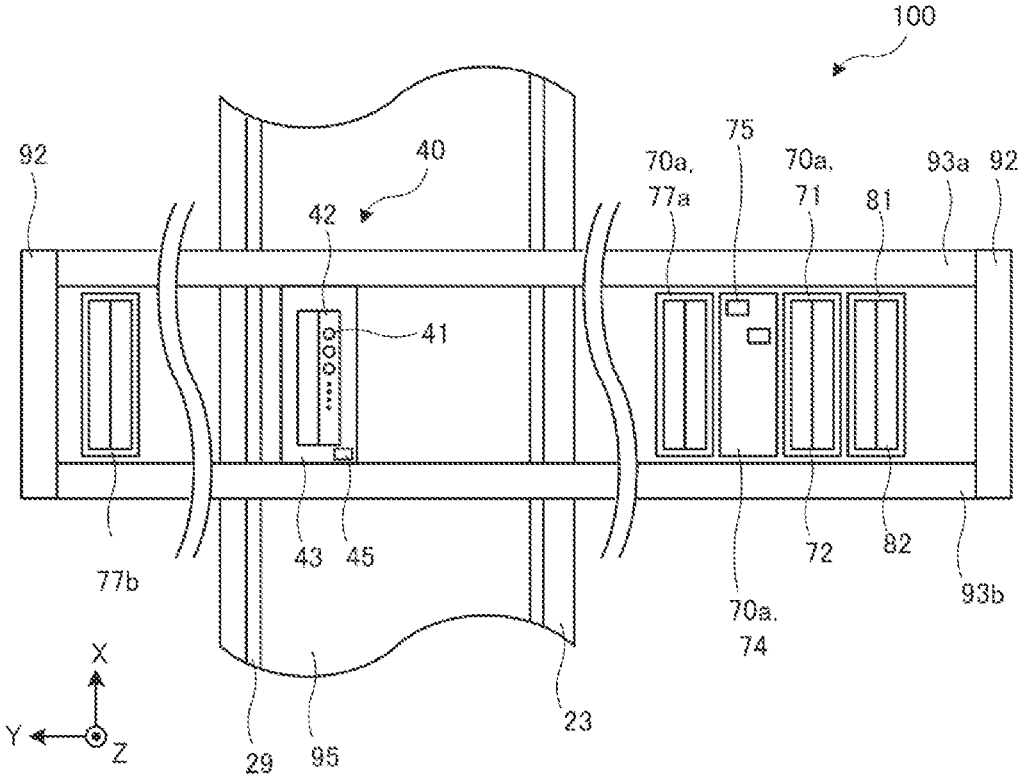
FIG. 2 is a plan view illustrating a configuration of a printing unit and a maintenance unit.
Figure 3:
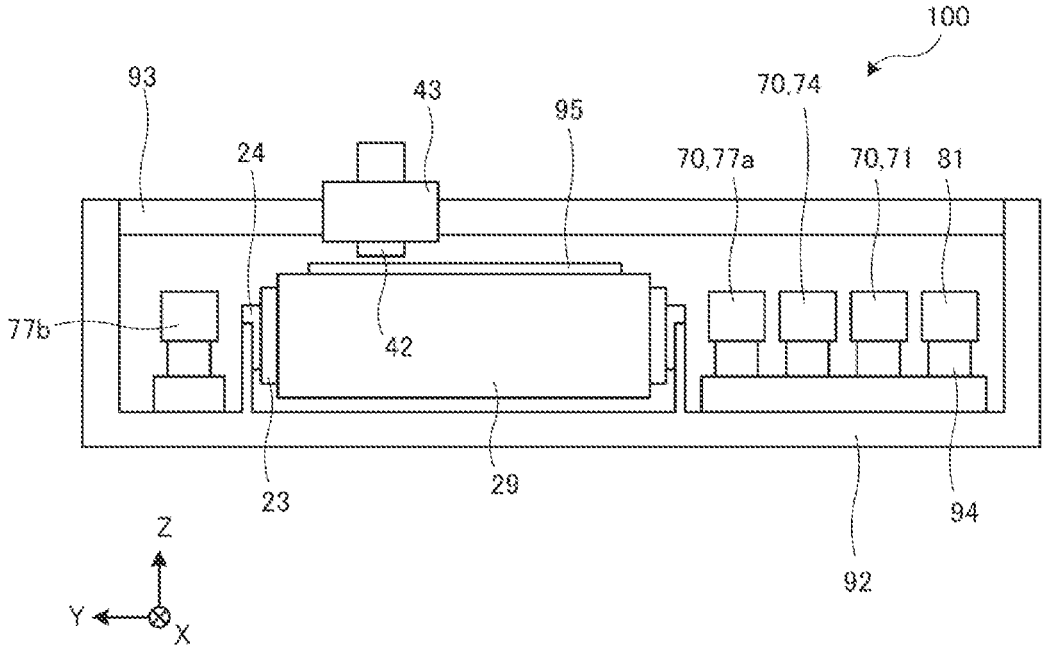
FIG. 3 is a side view illustrating a configuration of the printing unit and the maintenance unit.

FIG. 2 is a plan view illustrating a configuration of the printing unit 40 and a maintenance unit 70. FIG. 3 is a side view illustrating the configuration of the printing unit and the maintenance unit.

As illustrated in FIG. 2 and FIG. 3, the printing unit 40 includes a carriage 43 on which a print head 42 is mounted, and the like. The print head 42 is provided with nozzles 41 for ejecting of ink. The printing unit 40 includes a thermometer 45 for measuring an environmental temperature in the vicinity of the nozzles 41. The print head 42 is configured to reciprocate along the Y-axis direction by a carriage transport unit 93 described later. Specifically, the carriage 43 is configured to support the print head 42 and to reciprocate in the Y axis direction.

The print head 42 corresponds to an example of a recording head.

The Y axis direction corresponds to an example of a first direction.

The carriage transport unit 93 is configured to move the print head 42 along the Y axis direction in a reciprocating manner together with the carriage 43. The carriage transport unit 93 is disposed on a +Z axis direction side of the belt 23. The carriage transport unit 93 includes a pair of carriage transport units 93*a*, 93*b* that extend along the Y axis direction, a carriage position detecting device disposed along the carriage transport units 93*a*, 93*b*, and the like.

The carriage transport units 93*a*, 93*b* are extended between frame portions 92*a*, 92*b* that are provided in a standing manner outside the belt 23 in the X axis direction. The carriage transport units 93*a*, 93*b* support the carriage 43. The carriage 43 is guided by the carriage transport units 93*a*, 93*b* along the Y axis direction, and is supported by the carriage transport units 93*a*, 93*b* in a reciprocating manner in the Y axis direction. The carriage position detecting device extends along the carriage transport units 93*a*, 93*b*, and is configured to detect a position of the carriage 43 in the Y axis direction.

The carriage transport unit 93 includes a moving mechanism and a power source not illustrated in the drawing. As the moving mechanism, for example, a mechanism using a ball screw and a ball nut in combination, a linear guide mechanism, or the like can be adopted. Further, the carriage transport unit 93 is provided with a motor as a power source for moving the carriage 43 along the Y axis direction. As the motor, various kinds of motor such as a stepping motor, a servo motor, and a linear motor can be adopted. When the motor is driven by being controlled by the control unit 1, the print head 42 reciprocates along the Y axis direction together with the carriage 43.

The maintenance unit 70 and a cap unit 81 are described. The maintenance unit 70 and the cap unit 81 are provided on one end side of the belt 23 in the Y axis direction that the print head 42 reciprocates. The maintenance unit 70 and the cap unit 81 are disposed at a position overlapping with the print head 42 that reciprocates in the Y axis direction as viewed in plan view from a +Z axis direction side.

The printing apparatus 100 includes a support portion that supports the printing medium 95, and a plurality of flushing units 77 disposed on both sides of the support portion in the Y axis direction and receiving ink during a period in which flushing is performed. Specifically, at least one flushing unit 77*a* is provided to the maintenance unit 70, and at least one flushing unit 77*b* is disposed on the other end side in the Y axis direction of the belt 23.

In the present embodiment, as the plurality of maintenance units 70, a suction unit 71 configured to suck the print head 42, a wiping unit 74 configured to remove a liquid, and a flushing unit 77*a* configured to allow the nozzles 41 of the print head 42 to eject a liquid are provided. The respective maintenance units 70 and the cap unit 81 are arranged in the order of the cap unit 81, the suction unit 71, the wiping unit 74, and the flushing unit 77*a* from an end portion in the −Y axis direction toward the +Y axis direction. The maintenance units 70 and the cap unit 81 each include a lifting device 94 constituted of an air cylinder or the like, and when a maintenance operation is performed, the maintenance units 70 and the cap unit 81 are each lifted to a contact position where each unit is brought into contact with the print head 42 or an adjacent position where each unit is disposed close to the print head 42.

The cap unit 81 is a device configured to cover the print head 42. There is a case where ink ejected from the nozzles 41 provided to the print head 42 has volatility. In this case, when a solvent of ink existing inside the print head 42 volatilizes from the nozzles 41, there may be a case where the viscosity of ink is changed so that the nozzles 41 are clogged. The cap unit 81 includes a lid body 82, and covers the print head 42 by the lid body 82 thus preventing clogging of the nozzles 41.

The suction unit 71 is a device configured to cover the print head 42 and to suck ink in the print head 42. The suction unit 71 includes a lid body 72 and a negative pressure pump not illustrated in the drawing, and is configured to remove air bubbles, foreign materials, and the like in the print head 42 by a suction operation in which ink in the print head 42 is sucked by applying a negative pressure in the lid body 72 in a state where the print head 42 is covered by the lid body 72. With such an operation, it is possible to improve or prevent the ejection failure caused by air bubbles or foreign materials.

The wiping unit 74 is a device configured to wipe the print head 42. When solidified ink or foreign materials are stuck to the print head 42, an ejection failure may occur in which a droplet lands on an unexpected location on the printing medium 95. The wiping unit 74 includes blades 75, and a wiping motor for moving the blades 75 along the X axis direction. Due to a wiping operation in which the wiping unit 74 wipes ink or foreign materials sticking to the print head 42 with the blade 75, it is possible to improve or prevent the ejection failure.

Each of the flushing units 77 is a device configured to capture droplets ejected from the nozzles 41. Each of the flushing units 77 includes a flushing box having a porous fiber such as felt so as to capture droplets ejected from the nozzles 41 provided to the print head 42 at the time of cleaning an ink flow path in the print head 42. In a case where the viscosity of ink in the print head 42 is increased or a case where a solid material is mixed into the ink in the print head 42, a state of the ink is adjusted by removing the thickened ink and the solid material by performing the flushing operation in which droplets are ejected from the nozzles 41. With such an operation, it is possible to improve or prevent the ejection failure caused by the thickened ink or the solid material.

The suction unit 71 and the cap unit 81 may be integrally formed with each other.

Figure 4:
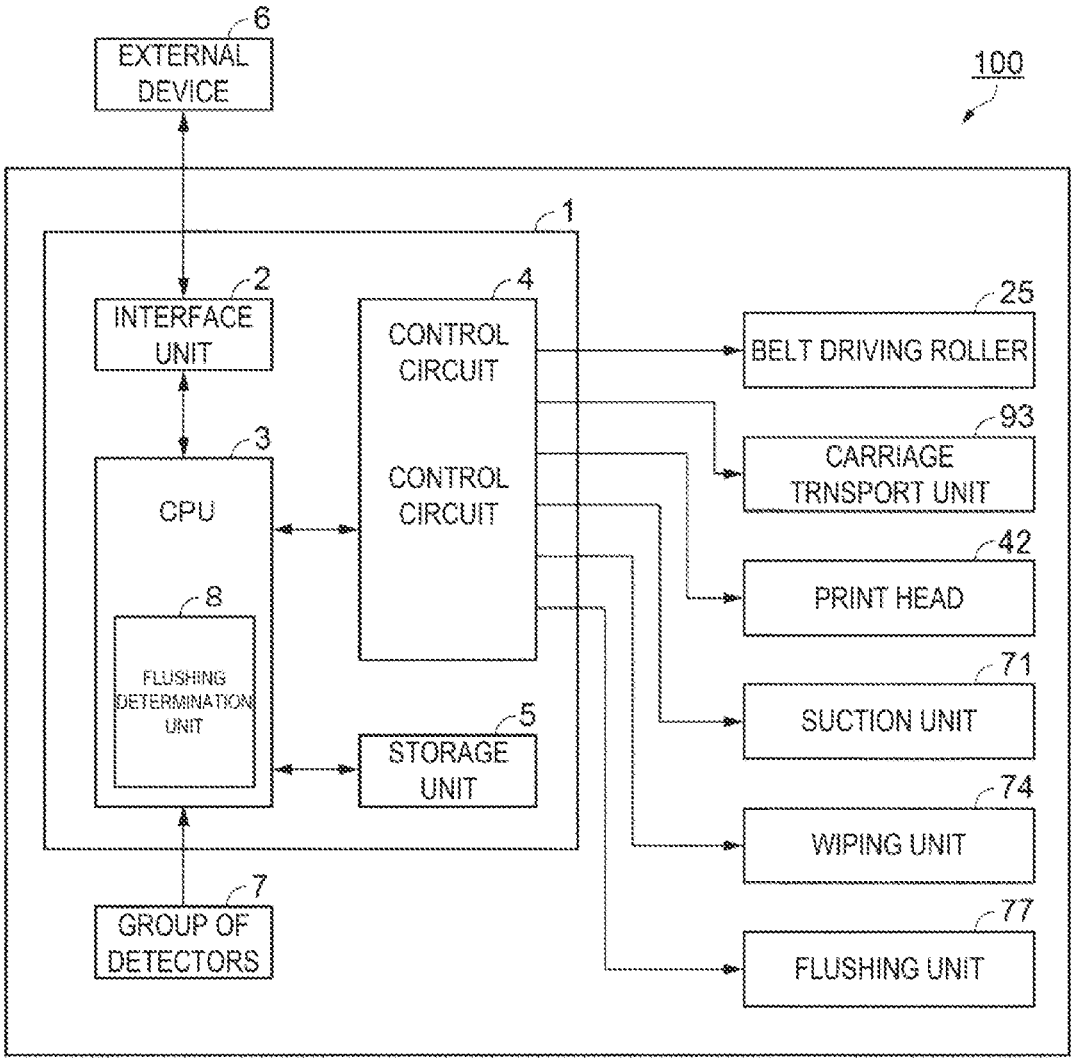
FIG. 4 is an electric block diagram illustrating an electrical configuration of the printing apparatus.

FIG. 4 is an electric block diagram illustrating an electrical configuration of the printing apparatus.

The printing apparatus 100 includes the control unit 1. The control unit 1 is a control unit configured to control the printing apparatus 100. The control unit 1 includes a control circuit 4, an interface unit 2, a CPU 3, and a storage unit 5. The interface unit 2 is provided for performing transmission and reception of data between an external device 6 configured to handle an image such as a computer and the printing apparatus 100. The CPU 3 is an operation processing device configured to perform processing of an input signal from a group of various kinds of detectors 7 and control of the entire printing apparatus 100.

The storage unit 5 is provided for ensuring a region for storing programs run by the CPU 3, a working area for running the programs, and the like, and includes a storage device such as a RAM, an electrically erasable programmable read only memory (EEPROM), a flash memory, a hard disk drive (HDD), a solid state drive (SSD), or the like.

The CPU 3 controls various kinds of motors provided to the belt driving roller 25 by the control circuit 4 to move the printing medium 95 in the X axis direction. The CPU 3 controls various kinds of motors provided to the carriage transport unit 93 by the control circuit 4 to move the carriage 43 on which the print head 42 is mounted in the Y axis direction. The CPU 3 controls a voltage of a piezoelectric element provided to the print head 42 by the control circuit 4 to allow the nozzles 41 to eject droplets to the printing medium 95. In the present embodiment, the printing apparatus 100 is configured such that a distance of one movement of the carriage 43 in the Y axis direction, that is, a return position in the reciprocating movement of the carriage 43 is determined not based on a predetermined distance that is determined preliminarily but based on print data to be printed in one reciprocating movement of the carriage 43 and hence, the printing throughput can be enhanced.

Here, the X axis direction corresponds to an example of a second direction orthogonal to the first direction.

The CPU 3 controls the lifting device 94 and a negative pressure pump provided to the suction unit 71 by the control circuit 4 to perform maintenance of the print head 42. The CPU 3 controls the lifting device 94 and the motor for moving the blades 75 provided to the wiping unit 74 by the control circuit 4 to perform maintenance of the print head 42. The CPU 3 controls the lifting device 94 provided to each flushing unit 77 by the control circuit 4 to perform maintenance of the print head 42. Further, the CPU 3 also controls respective units not illustrated in the drawing by the control circuit 4.

Figure 5:
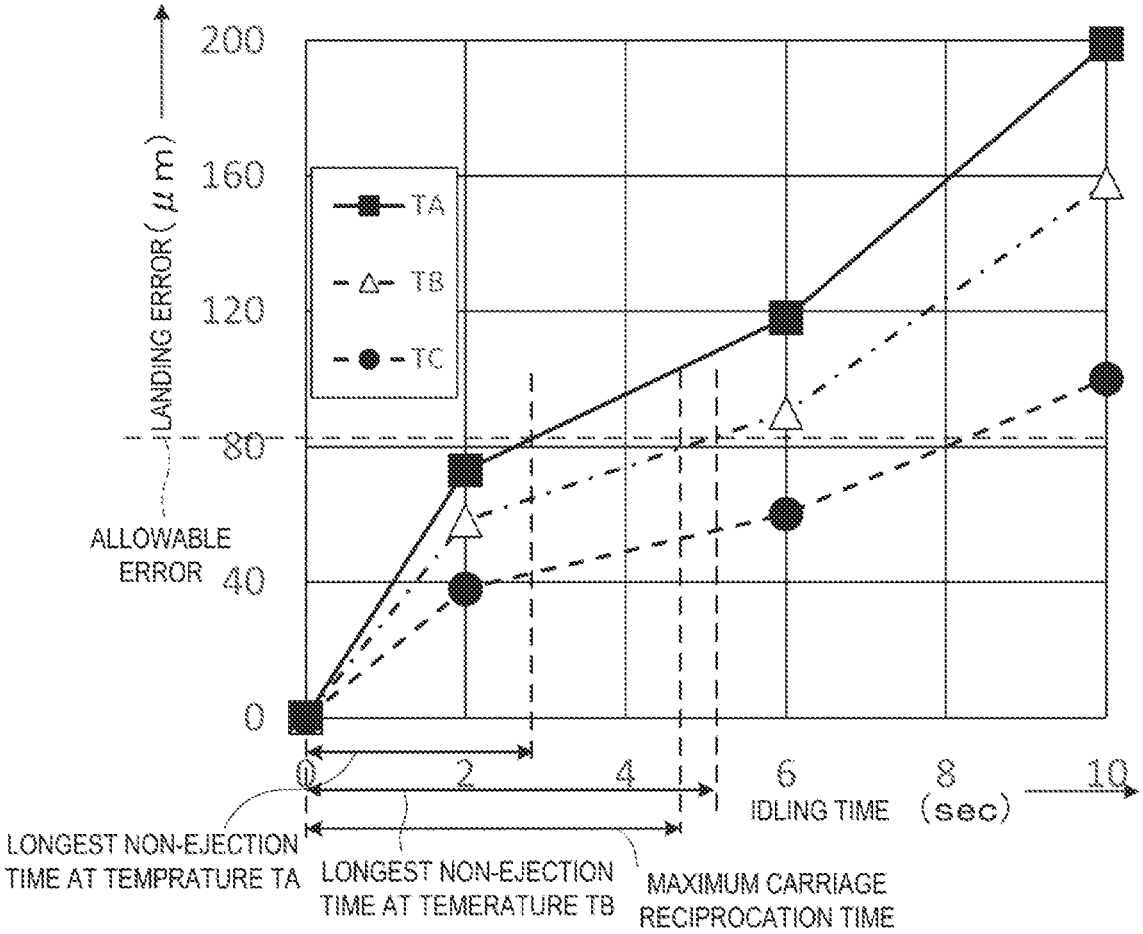
FIG. 5 is a view illustrating a relationship between an idling time and a landing error at each temperature when a carriage moving speed is fast.

FIG. 5 is a graph illustrating a relationship between an idling time and a landing error when a moving speed of the carriage 43 is fast. The line graphs corresponding to respective markers indicate the relationship between the idling time and the landing error at a temperature TA, a temperature TB, and a temperature TC, respectively. Specifically, for example, the temperature TA is 35 degrees Celsius, the temperature TB is 30 degrees Celsius, and the temperature TC is 25 degrees Celsius. As illustrated in FIG. 5, there is a tendency that the higher the environmental temperature, the faster the evaporation of the solvent contained in the ink becomes and hence, the landing error becomes large.

Here, the "idling time" is a time during which the carriage 43 moves in a state where droplets are not ejected from the nozzles 41, and is a non-ejection time. Specifically, when an allowable error that is an allowable value of the landing error of ink is approximately 80 μm, the longest non-ejection time allowed at the temperature TB is approximately 5 seconds, and the longest non-ejection time allowed at the temperature TA is slightly shorter than 3 seconds. Here, a time that the carriage 43 requires to move a maximum width is referred to as a maximum carriage reciprocating movement time. In a case where the landing error does not exceed the allowable error in the idling time within the maximum carriage reciprocating movement time, flushing may not be performed on the return path. With respect to a temperature within a temperature zone defined between the referenced temperature TA and the referenced temperature TC, the idling allowable time during which the relationship between the idling time and the landing error falls within the allowable error is calculated by linear interpolation, and whether to perform the flushing on the return path is determined based on the idling allowable time.

A moving speed of the carriage 43 corresponding to FIG. 5 is defined as a first speed, a correspondence relationship between a non-ejection time and a temperature in this case is defined as a first correspondence relationship, and a printing mode in this case is defined as a first mode.

A moving speed of the carriage 43 when the carriage 43 performs printing at a constant speed is expressed as a CR speed. A distance that the carriage 43 moves in a forward path of one reciprocating movement of the carriage 43 is expressed as a pass width. The sum of moving distances of the carriage 43 when the moving speed of the carriage 43 is accelerated or decelerate, in the forward path in one reciprocating movement of the carriage, is expressed as an acceleration and deceleration printing width. Further, the sum of times during which the carriage is accelerated or decelerated, in the forward path in one reciprocating movement of the carriage, is defined as an acceleration and deceleration time.

In one reciprocating movement of the carriage 43, a return position when the carriage 43 moves by an amount of a pass width corresponding to print data and returns based on print data to be printed in one reciprocating movement of the carriage 43 is defined as a temporary return position in the reciprocating movement of the carriage 43. In this case, a temporary reciprocating movement time $Time_{elapse}$, that is a reciprocating movement time of the carriage 43 necessary when the carriage 43 is returned at the temporary return position is expressed as the following equation (1).

[

Equation 1]

$$Time_{elapse} = \left( \frac{\text{(PASS WIDTH} - \text{ACCELERATION AND DECELERATION PRINTING WIDTH)}}{\text{(}CR\text{ SPEED)}} + \text{ACCELERATION AND DECELERATION TIME} \right) \times 2 \quad (1)$$

The longest non-ejection time allowed at the temperature TB is expressed as $Time_{ref0}$, and the longest non-ejection time allowed at the temperature TC is expressed as $Time_{ref1}$. Further, the temperature TB is expressed as $Temp_{ref0}$, and the temperature TC is expressed as $Temp_{ref1}$. In this case, the threshold value $Time_{thresh}$ that is the longest non-ejection time during which a condition that the landing error of droplets ejected from the nozzles 41 at the environmental temperature T becomes equal to or less than the allowable value is satisfied is expressed as the following equation (2), based on the idea of linear interpolation.

[

Equation 2]

$$Time_{thresh} = Time_{ref0} + (Time_{ref1} - Time_{ref0}) \times \frac{T - Temp_{ref0}}{Temp_{ref1} - Temp_{ref0}} \quad (2)$$

The printing apparatus 100 includes a flushing determination unit 8 configured to determine whether to perform flushing in the return path of the reciprocating movement of the carriage 43. The printing apparatus 100 includes a storage unit 5 configured to store a condition for a landing error of the droplet ejected from the nozzle to be equal to or less than a predetermined allowable value based on a preliminarily obtained correspondence relationship between a non-ejection time that is a time during which the droplets are not ejected from the nozzles 41 and a temperature.

The flushing determination unit 8 calculates, in one reciprocating movement of the carriage 43, a temporary return position, a temporary reciprocating movement time, and a threshold value $Time_{thresh}$ that is the longest non-ejection time that satisfies the condition at the environmental temperature T, based on print data to be printed in one reciprocating movement.

Further, the flushing determination unit 8 determines whether the temporary reciprocating movement time $Time_{elapse}$ exceeds the threshold value $Time_{thresh}$. In the present embodiment, flushing is performed from the print head 42 to the flushing unit 77*a* at the time of accelerating the carriage 43 in the forward path in the reciprocating movement of the carriage 43. Accordingly, when flushing is not performed in the return path of the reciprocating movement of the carriage 43, a time during which ejection of ink based on print data is not performed in the reciprocating movement of the carriage 43, that is, a non-ejection time during which the nozzles 41 do not eject the ink becomes a time from flushing performed in the forward path in the reciprocating movement of the carriage 43 to flushing performed in the forward path in the next reciprocating movement of the carriage 43, and the time becomes substantially equal to the reciprocating movement time of the carriage 43. Accordingly, by comparing the temporary reciprocating movement time $Time_{elapse}$ and the threshold value $Time_{thresh}$ with each other, it is possible to determine whether flushing is necessary during movement of the carriage 43 in the return path. Further, when the temporary reciprocating movement time $Time_{elapse}$ exceeds the threshold value $Time_{thresh}$, a position at which the one reciprocating movement time becomes longer than the temporary reciprocating movement time, that is, a position at which the one reciprocating movement time becomes longer than the threshold value $Time_{thresh}$ is set as the return position in the reciprocating movement of the carriage 43, and flushing is performed in the return path of the movement of the carriage 43. In the present embodiment, when flushing is performed in the return path of the reciprocating movement of the carriage 43, flushing is performed at the time of accelerating the carriage 43 in the return path. In the present embodiment, the temporary reciprocating movement time $Time_{elapse}$ is used synonymously with the non-ejection time at which the ejection of ink based on print data is not performed during the reciprocating movement of the carriage 43, that is, the nozzles 41 do not eject the ink.

The flushing determination unit 8 is realized by cooperation of software and hardware in which the CPU 3 executes a control program stored in the storage unit 5, in the control unit 1. The flushing operation is realized by controlling the carriage transport unit 93, the print head 42, the flushing units 77, and the like by the control unit 1 via the control circuit 4.

Figure 6:
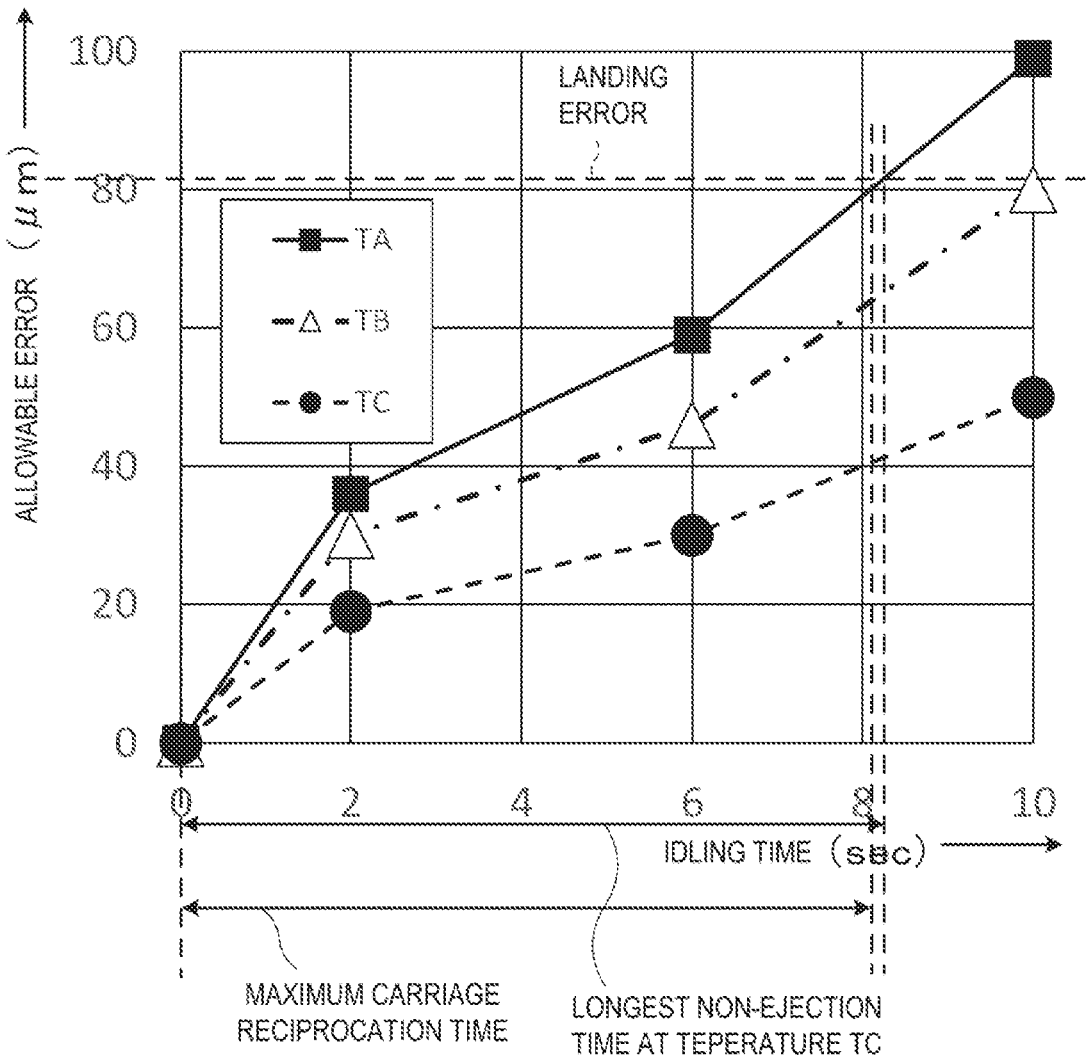
FIG. 6 is a view illustrating a relationship between an idling time and a landing error at each temperature when the carriage moving speed is slow.

FIG. 6 is a graph illustrating the relationship between the idling time and the landing error when the moving speed of the carriage 43 is slow.

A moving speed of the carriage 43 corresponding to FIG. 6 is defined as a second speed, a correspondence relationship between a non-ejection time and a temperature in this case is defined as a second correspondence relationship, and a printing mode in this case is defined as a second mode.

The line graphs corresponding to respective markers indicate the relationship between the idling time and the landing error at a temperature TA, a temperature TB, and a temperature TC, respectively. To be more specific, for example, the temperature TA is 35 degrees Celsius, the temperature TB is 30 degrees Celsius, and the temperature TC is 25 degrees Celsius.

In the case of FIG. 6, a shortest non-ejection time at which a landing error of droplets ejected from the nozzles 41 becomes the allowable error that is the predetermined allowable value is a period during which the environmental temperature T is the temperature TA and the non-ejection time is approximately 8 seconds. When the non-ejection time is shorter than approximately 8 seconds, the landing error becomes less than the allowable error at any temperature of TA, TB, and TC. In the relationship between the idling time and the landing error illustrated in FIG. 6, the maximum idling time is slightly shorter than the shortest non-ejection time of approximately 8 seconds. That is, when the moving speed of the carriage 43 is the second moving speed, the landing error is always less than the allowable error. Accordingly, in the case where an operation guarantee temperature is any one of TA to TC and the moving speed of the carriage 43 is the second moving speed, it is unnecessary to perform the flushing operation in the return path.

The flushing determination unit 8 of the printing apparatus 100 checks the moving speed of the carriage 43 at the time of printing, when the moving speed of the carriage 43 corresponds to the moving speed in the first mode, the flushing determination unit 8 determines whether the flushing operation is necessary in the return path, and when the moving speed of the carriage 43 corresponds to the moving speed in the second mode, the flushing determination unit 8 does not perform the flushing operation in the return path.

Figure 7:
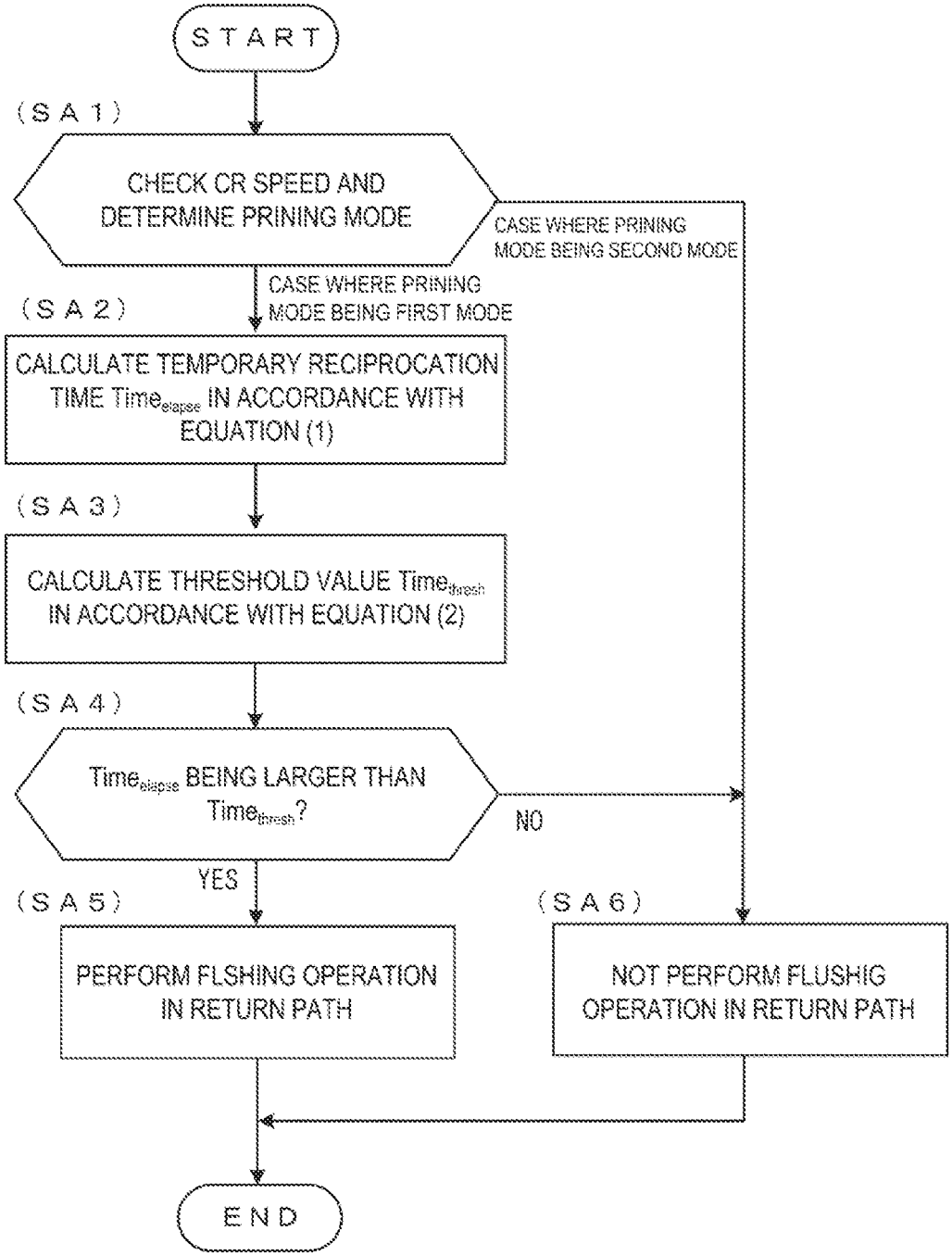
FIG. 7 is a flowchart illustrating an operation of a printing apparatus according to an embodiment.

FIG. 7 is a flowchart illustrating operations of the printing apparatus 100 according to the present embodiment and, specifically, a printing control method. The flushing determination unit 8 that the printing apparatus 100 includes checks the CR speed that is the moving speed of the carriage 43 set in advance, and determines the printing mode (step SA1). Specifically, for example, when the CR speed is 600 cps, the CR speed corresponds to an example of the first speed where the speed is fast, and the printing mode is brought into the first mode. Further, for example, when the CR speed is 300 cps, the CR speed corresponds to an example of the second speed where the speed is slow, and the printing mode is brought into the second mode.

When the printing mode is the first mode, the flushing determination unit 8 calculates the temporary reciprocating movement time $Time_{elapse}$ in accordance with the equation (1) (step SA2).

The flushing determination unit 8 calculates the threshold value $Time_{thresh}$ in accordance with the equation (2) (step SA3).

Here, a condition for a landing error of the droplet ejected from the nozzle to be equal to or less than a predetermined allowable value based on a correspondence relationship between a non-ejection time that is a time during which droplets are not ejected from the nozzles and a temperature corresponds to the line graphs illustrated in FIG. 5, for example.

Next, a calculated value of the temporary reciprocating movement time $Time_{elapse}$ and a value of the threshold value $Time_{thresh}$ are compared to each other (step SA4).

In a case where the value of the temporary reciprocating movement time $Time_{elapse}$ is larger than the value of the threshold value $Time_{thresh}$ (step SA4: YES), the printing apparatus 100 performs a flushing operation on the return path when the carriage 43 reciprocates (step SA5).

In a case where the value of the temporary reciprocating movement time $Time_{elapse}$ is equal to or less than the threshold value $Time_{thresh}$ (step SA4: NO), the printing apparatus 100 does not perform a flushing operation on the return path when the carriage 43 reciprocates (step SA6).

Further, when the printing mode is the second mode, the printing apparatus 100 does not perform a flushing operation on the return path when the carriage 43 reciprocates (step SA6).

In the present embodiment, step SA2 is carried out succeeding to step SA1. However, a determination processing may be added between step SA1 and step SA2. In the determination processing, an environmental temperature T is acquired using the thermometer 45, whether the environmental temperature T is equal to or more than a predetermined temperature is determined, when it is determined that the environmental temperature T is equal to or more than the predetermined temperature, the processing advances to step SA2, and when it is determined that the environmental temperature T is less than the predetermined temperature, the processing advances to step SA6. In a case where a time necessary for the carriage 43 to reciprocate the maximum distance in the first direction that the carriage 43 can move at a moving speed of the carriage in the selected printing mode is set as the maximum carriage reciprocating movement time, the predetermined temperature is an environmental temperature at which, in the correspondence relationship between the non-ejection time and the temperature, the landing error when the idling time becomes the maximum carriage reciprocating movement time becomes equal to or more than the allowable error. For example, in the relationship between the non-ejection time, the landing error, and the temperature illustrated in FIG. 5, the temperature TA is determined to be equal to or more than the predetermined temperature because the landing error when the idling time is the maximum carriage reciprocating movement time is equal to or more than the allowable error, and the temperature TB and the temperature TC are determined to be less than the predetermined temperature because the landing error when the idling time is the maximum carriage reciprocating movement time is less than the allowable error.

Specifically, the printing apparatus 100 includes the print head 42 configured to eject droplets to the printing medium 95 from the nozzles 41, the carriage 43 configured to support the print head 42 and reciprocate in the first direction, and the thermometer 45 configured to measure an environmental temperature in the vicinity of the nozzles. The printing apparatus 100 includes the control unit 1 configured to control the reciprocating movement of the carriage 43 and the ejection of droplets from the nozzles 41, and the flushing determination unit 8 configured to determine whether to perform flushing in the return path of the reciprocating movement of the carriage. Further, the printing apparatus 100 includes the storage unit configured to store a condition for a landing error of the droplet ejected from the nozzle to be equal to or less than a predetermined allowable value based on a preliminarily obtained correspondence relationship between a non-ejection time that is a time during which the droplets are not ejected from the nozzles 41 and a temperature.

The flushing determination unit 8 calculates, in one reciprocating movement of the carriage 43, a temporary return position in the reciprocating movement of the carriage 43 based on print data to be printed in the one reciprocating movement. Further, the flushing determination unit 8 calculates a temporary reciprocating movement time that is a one reciprocating movement time of the carriage necessary when the carriage returns at the temporary return position. Further, the flushing determination unit 8 calculates a threshold value that is the longest non-ejection time that satisfies the condition at the environmental temperature measured by the thermometer 45.

The flushing determination unit 8 determines whether the temporary reciprocating movement time exceeds the threshold value. When it is determined that the temporary reciprocating movement time exceeds the threshold value, the flushing determination unit 8 sets a position at which one-tie reciprocating movement time becomes longer than the temporary reciprocating movement time, that is, a position at which the one reciprocating movement time becomes longer than the threshold value $Time_{thresh}$ as a return position in the reciprocating movement of the carriage 43, and determines to perform flushing in the return path of the movement of the carriage 43.

In the present embodiment, it is desirable that the printing apparatus 100 be configured to perform the flushing operation in the return path of the flushing unit 77*b* of the maintenance unit 70.

1. Modification 1

Figure 8:
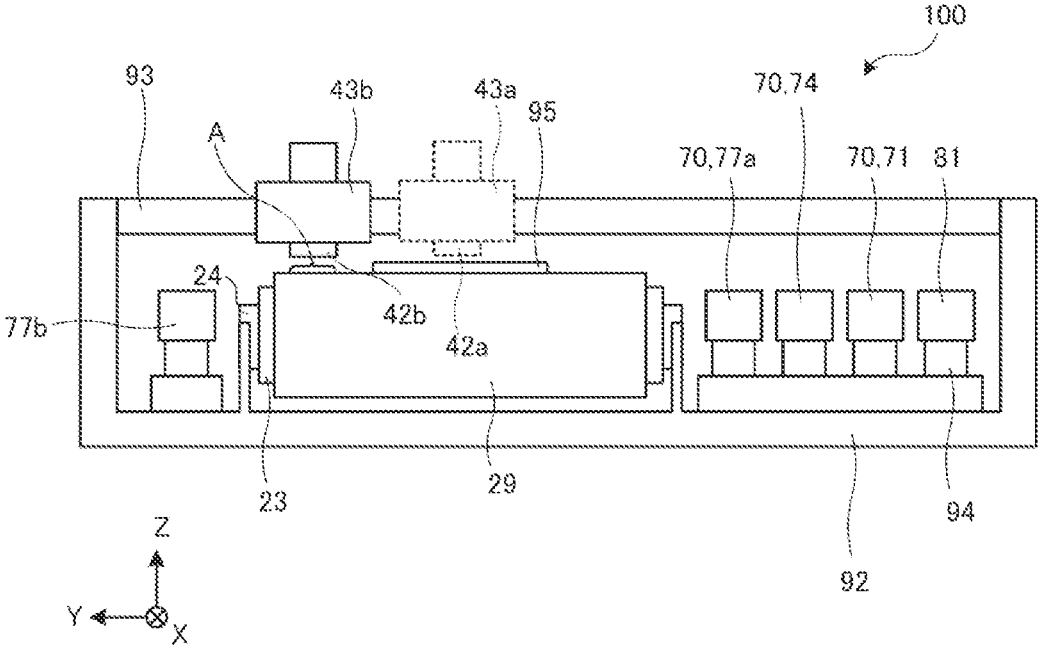
FIG. 8 is an explanatory view illustrating an operation of a printing apparatus according to a modification.

FIG. 8 is an explanatory view illustrating the manner of operation of a printing apparatus 100 according to a modification of the present embodiment. The printing apparatus 100 includes a belt 23 that supports a printing medium 95.

The belt 23 corresponds to an example of the support portion.

The printing apparatus 100 includes a plurality of flushing units 77 disposed on both sides of the support portion in the first direction, and receiving ink during a period in which flushing is performed. A flushing determination unit 8 is configured to determine whether to perform flushing in a return path of reciprocating movement of a carriage 43. In a case where the flushing determination unit 8 determines to perform the flushing in the return path of the movement of the carriage, the flushing determination unit 8 determines whether the flushing operation in the return path of the reciprocating movement of the carriage is to be performed in the flushing unit 77*b* or in a region not overlapping with a printing medium 95 of the support portion, in accordance with a width of the printing medium 95. Further, the flushing determination unit 8 sets a return position based on the determination.

In the modification 1, the description is made with respect to a case where the width of the printing medium 95 is narrow, and the belt 23 is not covered by the printing medium 95. In this case, the printing apparatus 100 is configured such that, when it is determined that the flushing is performed in the return path of the movement of the carriage, provided that the flushing can be performed in a region A not overlapping with the printing medium 95 on the belt 23, the flushing in the return path is not performed in the flushing unit 77*b*, the flushing operation in the return path is performed in the region A not overlapping with the printing medium 95 on the belt 23 without moving the carriage 43 to the flushing unit 77*b* and hence, the printing throughput can be enhanced. The belt 23 is periodically cleaned by the cleaning unit 51 and hence, a possibility that the printing medium 95 is contaminated by excess ink sticking to a front surface of the belt 23 is low.

2. Modification 2

The printing medium 95 supported by the belt 23 is transported in a second direction perpendicular to the first direction during printing, and specifically, in the case of FIG. 2, is transported in the +X axis direction. A time during which the printing medium 95 is transported is defined as a relative movement time. Further, a deceleration time of the carriage 43 in a forward path of a current reciprocating movement is referred to as a deceleration time of a current pass forward path, a deceleration time of the carriage 43 in a return path of the current reciprocating movement is referred to as a deceleration time of a current pass return path, and an acceleration time of the carriage 43 in a forward path of a next reciprocating movement is referred to as an acceleration time of a next pass forward path. (The same goes for the following embodiments)

In a case where the relative movement time is longer than the sum of the deceleration time of the current pass return path and the acceleration time of the next pass forward path, when a time during which ejection of ink based on print data is not performed in the reciprocating movement of the carriage 43, that is, a non-ejection time during which the nozzles 41 do not eject the ink is considered, it is necessary to add the relative movement time in addition to the temporary reciprocating movement time $Time_{elapse}$. Specifically, it is necessary to add a time, within the relative movement time, that exceeds the sum of the deceleration time of the current pass return path and the acceleration time of the next pass forward path to the temporary reciprocating movement time $Time_{elapse}$.

Specifically, the temporary reciprocating movement time $Time_{elapse}$ is calculated by the following equation (3) when the relative movement time, that is a time associated with the relative movement between the print head 42 and the printing medium 95 in the second direction orthogonal to the first direction performed after the ejection of droplets from the print head 42 to the printing medium 95 along with the reciprocating movement of the carriage 43 is longer than the acceleration and deceleration time.

[Equation 3]

$$Time_{elapse} = \left(\frac{\text{(PASS WIDTH – ACCELERATION AND DECELERATION PRINTING WIDTH)}}{\text{(CR SPEED)}} + \text{ACCELERATION AND DECELERATION TIME}\right) \times 2 + \text{(RELATIVE MOVEMENT TIME – DECLARATION TIME OF CURRENT PASS RETURN PATH – ACCELERATION TIME OF NEXT PASS FORWARD PATH)} \quad (3)$$

The flushing determination unit 8 determines whether the temporary reciprocating movement time $Time_{elapse}$ exceeds the threshold value $Time_{thresh}$. In a case where the temporary reciprocating movement time $Time_{elapse}$ exceeds the threshold value $Time_{thresh}$, a position at which the one reciprocating movement time becomes longer than the temporary reciprocating movement time, that is, a position at which the one reciprocating movement time becomes longer than the threshold value $Time_{thresh}$ is set as the return position in the reciprocating movement of the carriage 43, and flushing is performed in the return path of the movement of the carriage 43.

In the same manner as the above-mentioned embodiment, the threshold value $Time_{thresh}$ is calculated using the equation (2) from a condition for a landing error of the droplet ejected from the nozzle to be equal to or less than a predetermined allowable value based on the preliminarily obtained correspondence relationship between the non-ejection time that is a time during which droplets are not ejected from the nozzles and the temperature.

3. Modification 3

In a case where a wait time, that is a standby time of the carriage 43, is provided between passes, that is, between the current path and the next path, it is necessary to take into account the wait time as the non-ejection time. In the present embodiment, the wait time starts with starting of the deceleration of the carriage 43. However, the present disclosure is not limited to such a configuration. The wait time includes a first wait time provided between the current pass forward path and the current pass return path, and a second wait time provided between the current pass return path and the next pass forward path. The substantial wait time to be considered should be added as the non-ejection time. Specifically, $Time_{elapse}$ is calculated by the following equation (4) when the relative movement time is longer than the second wait time, the temporary reciprocating movement time.

[Equation 4]

$$Time_{elapse} = \left(\frac{\text{(PASS WIDTH – ACCELERATION AND DECELERATION PRINTING WIDTH)}}{\text{(CR SPEED)}} + \text{ACCELERATION AND DECELERATION TIME}\right) \times 2 + \text{(RELATIVE MOVEMENT TIME – DECLARATION TIME OF CURRENT PASS RETURN PATH – ACCELERATION TIME OF NEXT PASS FORWARD PATH)} \quad (4)$$

Further, the temporary reciprocating movement time $Time_{elapse}$ is calculated by the following equation (5) when the relative movement time is equal to or less than the second wait time.

[Equation 5]

$$Time_{elapse} = \left(\frac{\text{(PASS WIDTH – ACCELERATION AND DECELERATION PRINTING WIDTH)}}{\text{(CR SPEED)}} + \text{ACCELERATION AND DECELERATION TIME}\right) \times 2 + \text{(RELATIVE MOVEMENT TIME – DECLARATION TIME OF CURRENT PASS RETURN PATH – ACCELERATION TIME OF NEXT PASS FORWARD PATH)} \quad (5)$$

The flushing determination unit 8 determines whether the temporary reciprocating movement time $Time_{elapse}$ exceeds the threshold $value_{thresh}$. In a case where the temporary reciprocating movement time $Time_{elapse}$ exceeds the threshold value $Time_{thresh}$, a position at which the one reciprocating movement time becomes longer than the temporary reciprocating movement time, that is, a position at which the one reciprocating movement time becomes longer than the threshold value $Time_{thresh}$ is set as the return position in the reciprocating movement of the carriage 43, and flushing is performed in the return path of the reciprocating movement of the carriage 43.

In the same manner as the above-mentioned embodiment, the threshold value $Time_{thresh}$ is calculated using the equation (2) from a condition for a landing error of the droplet ejected from the nozzle to be equal to or less than a predetermined allowable value based on the preliminarily obtained correspondence relationship between the non-ejection time that is a time during which droplets are not ejected from the nozzles and the temperature.

4. Modification 4

In the above-mentioned embodiment, the condition that the landing error becomes equal to or less than the allowable value at the environmental temperature T measured by the thermometer is obtained from the relationship between the non-ejection time of the ink and the reciprocating movement time in one movement of the carriage 43 based on the print data. In the present modification, the condition that the landing error becomes equal to or less than the allowable value at the temperature T is obtained from the relationship between the non-ejection distance at a predetermined moving speed of the carriage 43 and the reciprocating movement distance in one movement of the carriage 43 based on the print data.

Specifically, the printing apparatus 100 includes: a print head 42 configured to eject a droplet from nozzles 41 to a printing medium 95, a carriage 43 configured to reciprocate in a first direction in a state where the carriage 43 supports the print head 42, a thermometer 45 configured to measure an environmental temperature in the vicinity of the nozzles 41, a control unit 1 configured to control reciprocating movement of the carriage 43 and ejection of the droplets from the nozzles 41, a flushing determination unit 8 configured to determine whether to perform flushing in a return path of the reciprocating movement of the carriage 43, and a storage unit 5 configured to store a condition for a landing error of the droplet ejected from the nozzle 41 to be equal to or less than a predetermined allowable value based on a preliminarily obtained correspondence relationship between a non-ejection distance that is a distance along which the droplets are not ejected from the nozzles 41 and a temperature, wherein the flushing determination unit 8 is configured to: calculate, in one reciprocating movement of the carriage 43, based of print data to be printed in the one reciprocating movement, a temporary return position in the reciprocating movement of the carriage 43, a temporary reciprocating movement distance that is a one reciprocating movement distance of the carriage 43 when the carriage 43 is returned at the temporary return position, and a third threshold value that is a longest non-ejection distance that satisfies the condition at the environmental temperature measured by the thermometer 45, and determine whether the temporary reciprocating movement distance exceeds the third threshold value, wherein when the temporary reciprocating movement distance exceeds the third threshold value, the flushing determination unit 8 sets a position at which the one reciprocating movement distance becomes longer than the temporary reciprocating movement distance, the position being a position at which the one reciprocating movement distance becomes longer than the threshold value, as a return position in the reciprocating movement of the carriage 43, and determines to perform the flushing in the return path of the movement of the carriage 43.

The printing apparatus 100 according to the embodiment of the present disclosure includes: the print head 42 configured to eject droplets from the nozzles 41 to the printing medium 95, the carriage 43 configured to reciprocate in the first direction in a state where the carriage 43 supports the print head 42, the thermometer 45 configured to measure an environmental temperature in the vicinity of the nozzles 41, the control unit 1 configured to control reciprocating movement of the carriage 43 and ejection of the droplets from the nozzles 41, the flushing determination unit 8 configured to determine whether to perform flushing in a return path of the reciprocating movement of the carriage 43, and the storage unit 5 configured to store a preliminarily obtained correspondence relationship between the non-ejection time that is a time during which the droplets are not ejected from the nozzles 41 and the temperature, the correspondence relationship being the condition that the landing error of the droplets ejected from the nozzles 41 becomes equal to or less than the predetermined allowable value, wherein the flushing determination unit 8 is configured to: calculate, in one reciprocating movement of the carriage 43, based on print data to be printed in the reciprocating movement of the carriage 43, the temporary return position in the reciprocating movement of the carriage 43, the temporary reciprocating movement time that is a one reciprocating movement time of the carriage 43 necessary when the carriage 43 is returned at the temporary return position, and the threshold value that is a longest non-ejection time that satisfies the condition at the environmental temperature measured by the thermometer 45, and determine whether the temporary reciprocating movement time exceeds the threshold value, wherein when the temporary reciprocating movement time exceeds the threshold value, the flushing determination unit 8 sets a position at which the one reciprocating movement time becomes longer than the temporary reciprocating movement time, the position being a position at which the one reciprocating movement time becomes longer than the threshold value $Time_{thresh}$, as the return position in the reciprocating movement of the carriage 43, and determines to perform the flushing in the return path of the movement of the carriage 43.

According to the printing apparatus 100 described above, by performing flushing in the return path of the movement of the carriage, it is possible to obtain an excellent effect that the standing time during which the ink is not ejected from the nozzles 41 can be shortened so that clogging of the nozzles 41 by the ink can be prevented thus stabilizing a quality of an image. Further, the threshold value, that is the optimal longest non-ejection time is calculated corresponding to a temperature of the environment where the nozzles are located, and the necessity of flushing in the return path is determined by comparing the threshold value and the reciprocating movement time of the carriage 43 predicted from the print data with each other and hence, the number of times of flushing can be minimized.

The printing apparatus 100 according to the embodiment of the present disclosure includes: the belt 23 configured to support the printing medium 95, and the plurality of flushing units 77 disposed on both sides of the belt 23 in the first direction and configured to receive ink while flushing is performed, and the flushing determination unit 8 is configured to determine, when the flushing determination unit 8 determines to perform flushing in the return path of the reciprocating movement of the carriage, whether the flushing in the return path of the movement of the carriage is to be performed in the flushing unit 77*b* or in the region not overlapping with the printing medium 95 on the belt 23, in accordance with a width of the printing medium 95, and sets a return position based on the determination.

According to the printing apparatus 100 described above, the flushing can be performed not in the flushing units 77 disposed on both ends of the belt 23 but in the position not overlapping with the printing medium 95 on the belt 23 and hence, it is possible to obtain an excellent effect that the throughput can be enhanced.

The printing apparatus 100 according to the embodiment of the present disclosure includes: as the printing mode, the first mode in which the moving speed of the carriage 43 is the first speed, and the second mode in which the moving speed of the carriage 43 is the second speed that is different from the first speed, and the correspondence relationship includes: a first correspondence relationship when the moving speed of the carriage 43 is the first speed, and a second correspondence relationship when the moving speed of the carriage 43 is the second speed, and the flushing determination unit 8 calculates the threshold value using the first correspondence relationship as a correspondence relationship when the printing mode is the first mode, and calculates the threshold value using the second correspondence relationship as a correspondence relationship when the printing mode is the second mode.

According to the printing apparatus 100 described above, the correspondence relationship between the non-discharge time that is a time during which the droplets are not ejected from the nozzles 41 and the temperature, where the landing error can be the allowable value can be adopted in accordance with the moving speed of the carriage and hence, it is possible to obtain an excellent effect that the printing apparatus 100 can perform the flushing operation appropriately.

In the printing apparatus 100 according to the embodiment of the present disclosure, $Time_{elapse}$ indicating the temporary reciprocating movement time is expressed by the following equation (1), wherein a moving speed of the carriage 43 when the carriage 43 performs printing at a constant speed is a CR speed, a distance that the carriage 43 moves the forward path in onetime reciprocating movement is a pass width, a sum of distances that the carriage 43 moves accelerating or decelerating in the forward path of one reciprocating movement is an acceleration and deceleration printing width, and a sum of times during which the carriage 43 is accelerated or decelerated in the forward path of one reciprocating movement is an acceleration and deceleration time.

[Equation 6]

$$Time_{elapse} = \left(\frac{\text{PASS WIDTH} - \text{ACCELERATION AND DECELERATION PRINTING WIDTH}}{(CR\ \text{SPEED})} + \text{ACCELERATION AND DECELERATION TIME}\right) \times 2 \quad (1)$$

$Time_{thresh}$ indicating a threshold value at the environmental temperature T is expressed by the following equation (2), wherein threshold values (the maximum value of the non-ejection time) respectively corresponding to $Temp_{ref0}$ indicating a first reference temperature and $Temp_{ref1}$ indicating a second reference temperature, the first and second reference temperatures being two predetermined different temperatures, are respectively defined as $Time_{ref0}$ indicating a first threshold value and $Time_{ref1}$ indicating a second threshold value.

[Equation 7]

$$Time_{thresh} = Time_{ref0} + (Time_{ref1} - Time_{ref0}) \times \frac{T - Temp_{ref0}}{Temp_{ref1} - Temp_{ref0}} \quad (2)$$

According to the printing apparatus 100 described above, it is possible to compare $Time_{thresh}$ indicating a threshold value of the longest non-ejection time that causes the landing error to be equal to or less than the predetermined allowable value at the temperature T in the vicinity of the nozzles and the one reciprocating movement time of the carriage 43 (the maximum non-ejection time) with each other and hence, it is possible to obtain an excellent effect that the printing apparatus 100 can perform the flushing operation appropriately.

In the printing apparatus 100 according to the embodiment of the present disclosure, $Time_{elapse}$ is expressed by the following equation (3), when the relative movement time that is a time associated with the relative movement between the print head 42 and the printing medium 95 in the second direction orthogonal to the first direction performed after the ejection of droplets from the print head 42 to the printing medium 95 along with the reciprocating movement of the carriage 43 is longer than the acceleration and deceleration time.

[Equation 8]

$$Time_{elapse} = \left(\frac{\text{(PASS WIDTH} - \text{ACCELERATION AND DECELERATION PRINTING WIDTH)}}{(CR\ \text{SPEED})} + \text{ACCELERATION AND DECELERATION TIME}\right) \times 2 + \text{(RELATIVE MOVEMENT TIME} - \text{DECLARATION TIME OF CURRENT PASS RETURN PATH} - \text{ACCELERATION TIME OF NEXT PASS FORWARD PATH)} \quad (3)$$

According to the printing apparatus 100 described above, it is possible to obtain an excellent effect that, when the printing medium 95 is moved in the second direction perpendicular to the first direction relative to the print head 42, an appropriate frequency of the flushing operation can be calculated even when the relative movement is performed longer than the acceleration and deceleration time of the carriage 43.

In the printing apparatus 100 according to the embodiment of the present disclosure, when the wait time is provided between the passes, assuming a wait time provided between a current pass forward path and a current pass return path as a first wait time, and a wait time provided between the current pass return path and a next pass forward path as a second wait time, $Time_{elapse}$ is expressed by the following equation (4) when the relative movement time is longer than the second wait time.

[Equation 9]

$$Time_{elapse} = \left(\frac{\text{(PASS WIDTH} - \text{ACCELERATION AND DECELERATION PRINTING WIDTH)}}{(CR\ \text{SPEED})} + \right. \quad (4)$$

-continued $$\text{ACCELERATION AND DECELERATION TIME}\Big)\times 2+$$

$$\text{(RELATIVE MOVEMENT TIME} - \text{DECLARATION TIME OF CURRENT PASS RETURN PATH} - \text{ACCELERATION TIME OF NEXT PASS FORWARD PATH)}$$

Further, $Time_{elapse}$ is expressed by the following equation (5) when the relative movement time is equal to or less than the second wait time.

[Equation 10]

$$Time_{elapse} = \left(\frac{\text{(PASS WIDTH} - \text{ACCELERATION AND DECELERATION PRINTING WIDTH)}}{\text{(}CR\text{ SPEED)}} + \text{ACCELERATION AND DECELERATION TIME}\right)\times 2+ \text{(RELATIVE MOVEMENT TIME} - \text{DECLARATION TIME OF CURRENT PASS RETURN PATH} - \text{ACCELERATION TIME OF NEXT PASS FORWARD PATH)} \quad (5)$$

According to the printing apparatus 100 described above, it is possible to acquire an excellent effect that an appropriate frequency of the flushing operations can be calculated even when the wait time is provided between the passes.

The printing apparatus 100 according to the embodiment of the present disclosure includes: the print head 42 configured to eject droplets from the nozzles 41 to the printing medium 95, the carriage 43 configured to reciprocate in the first direction in a state where the carriage 43 supports the print head 42, the thermometer 45 configured to measure an environmental temperature in the vicinity of the nozzles 41, the control unit configured to control the reciprocating movement of the carriage 43 and the ejection of the droplets from the nozzles 41, the flushing determination unit 8 configured to determine whether to perform flushing in the return path of the reciprocating movement of the carriage 43, and the storage unit configured to store a condition for a landing error of the droplet ejected from the nozzle 41 to be equal to or less than a predetermined allowable value based on a preliminarily obtained correspondence relationship between a non-ejection distance that is a distance along which the droplets are not ejected from the nozzles 41 and a temperature, wherein the flushing determination unit 8 is configured to: calculate, in one reciprocating movement of the carriage 43, based on print data to be printed in the one reciprocating movement, a temporary return position in the reciprocating movement of the carriage 43, a temporary reciprocating movement distance that is a one reciprocating movement distance of the carriage 43 when the carriage 43 is returned at the temporary return position, and a third threshold value that is a longest non-ejection distance that satisfies the condition at the environmental temperature measured by the thermometer 45, determine whether the temporary reciprocating movement distance exceeds the third threshold value, wherein when the temporary reciprocating movement distance exceeds the third threshold value, the flushing determination unit 8 sets a position at which the one reciprocating movement distance becomes longer than the third threshold value, the position being a position at which the one reciprocating movement distance becomes longer than the temporary reciprocating movement distance, as a return position in the reciprocating movement of the carriage 43, and determines to perform the flushing in the return path of the movement of the carriage.

According to the printing apparatus 100 described above, it is possible to acquire an advantageous effect that the optimal frequency of flushing can be calculated from a reciprocating movement distance of the carriage 43 estimated based on print data and a third threshold value that is the maximum non-ejection distance at the environmental temperature in the vicinity of the nozzles 41 so that a quality of an image can be stabilized.

In the printing apparatus 100 including: the print head 42 configured to eject droplets from the nozzles 41 to the printing medium 95, the carriage 43 configured to reciprocate in the first direction in a state where the carriage 43 supports the print head 42, the thermometer 45 configured to measure an environmental temperature in the vicinity of the nozzles 41, and the control unit 1 configured to control reciprocating movement of the carriage 43 and ejection of the droplets from the nozzles 41, the printing control method according to the embodiment of the present disclosure including: determining whether to perform flushing in a return path of the reciprocating movement of the carriage 43, storing a condition for a landing error of the droplet ejected from the nozzle 41 to be equal to or less than a predetermined allowable value based on a preliminarily obtained correspondence relationship between a non-ejection time that is a time during which the droplets are not ejected from the nozzles 41 and a temperature, wherein in the determining, in one reciprocating movement of the carriage 43, based on print data to be printed in the one reciprocating movement, a temporary return position in the reciprocating movement of the carriage 43, a temporary reciprocating movement time that is a one reciprocating movement time of the carriage 43 necessary when the carriage 43 is returned at the temporary return position, and a threshold value that is a longest non-ejection time that satisfies the condition at the environmental temperature measured by the thermometer 45 are calculated, and whether the temporarily reciprocating movement time exceeds the threshold value is determined, wherein when the temporarily reciprocating movement time exceeds the threshold value, a position at which the one reciprocating movement time becomes longer than the temporary reciprocating movement time, the position being a position at which the one reciprocating movement time becomes longer than the threshold value $Time_{thresh}$, is set as a return position in the reciprocating movement of the carriage 43, and performing flushing in the return path of the reciprocating movement of the carriage is decided.

According to the printing apparatus 100 described above, by performing flushing in the return path of the movement of the carriage, it is possible to obtain an excellent effect that the standing time during which the ink is not ejected from the nozzles 41 can be shortened so that clogging of the nozzles 41 by the ink can be prevented thus stabilizing an image quality. Further, the threshold value, that is the optimal longest non-ejection time is calculated corresponding to a temperature of the environment where the nozzles are located, and the necessity of flushing in the return path is determined by comparing the threshold value and the reciprocating movement time of the carriage 43 predicted from the print data with each other and hence, the number of times of flushing can be minimized.

The embodiment described above is merely an aspect of the present disclosure, and can be arbitrarily modified and applied within the scope of the present disclosure.

For example, in the embodiment described above, the printer is exemplified as the printing apparatus. However, the printing apparatus according to the present disclosure is not limited to the printer, and may be a composite machine having functions such as a scanning function, a facsimile function, and the like, for example.

For example, a function of the control unit 1 may be realized by a plurality of processors or a semiconductor chip.

For example, each unit illustrated in FIG. 1 is an example, and a specific implementation is not particularly limited. That is, it is not always necessary to mount hardware individually corresponding to each unit, and, as a matter of course, a configuration may be adopted where a function of each unit is realized by executing a program by one processor. Further, in the embodiment described above, some of the functions realized by software may be realized by hardware, or some of the functions realized by hardware may be realized by software. Still further, the specific and detailed configurations of other parts of the printing apparatus 100 and the control unit 1 may also be arbitrary modified without departing from the gist of the present disclosure.

For example, the number of steps of the operation illustrated in FIG. 7 is decided by dividing the operation corresponding to main processing contents for facilitating the understanding of the operations of the respective units of the printing apparatus 100. Accordingly, the present disclosure is not limited by the manner of dividing the operation illustrated in FIG. 7 into the steps and the names of the steps. The operation may be divided into a larger number of steps depending on the processing contents. Further, the operation illustrated in FIG. 7 may be divided such that one step includes a larger number of processing. Further, the order of steps may be suitably changed within a range that the gist of the present disclosure is not impaired.

What is claimed is:

1. A printing apparatus comprising:

an ink jet-type recording head configured to eject a droplet from a nozzle to a printing medium;

a carriage configured to reciprocate in a first direction while supporting the recording head;

a thermometer configured to measure an environmental temperature in a vicinity of the nozzle;

a control unit configured to control the reciprocating movement of the carriage and ejection of the droplet from the nozzle;

a flushing determination unit configured to determine whether to perform flushing in a return path of the reciprocating movement of the carriage; and a storage unit configured to store a condition for a landing error of the droplet ejected from the nozzle to be equal to or less than a predetermined allowable value based on a preliminarily obtained correspondence relationship between a non-ejection time that is a time during which the droplet is not ejected from the nozzle and a temperature, wherein the flushing determination unit is configured to:

calculate, in one reciprocating movement of the carriage, based on print data to be printed in the one reciprocating movement, a temporary return position in the reciprocating movement of the carriage, a temporary reciprocating movement time that is the one reciprocating movement time of the carriage necessary when the carriage is returned at the temporary return position, and a threshold value that is a longest non-ejection time that satisfies the condition at the environmental temperature measured by the thermometer; and determine whether the temporary reciprocating movement time exceeds the threshold value, and when the temporary reciprocating movement time exceeds the threshold value, the flushing determination unit sets a position at which the one reciprocating movement time becomes longer than the temporary reciprocating movement time as a return position in the reciprocating movement of the carriage, and also determines to perform the flushing in the return path of the movement of the carriage.

2. The printing apparatus according to claim 1, comprising:

a support portion configured to support the printing medium; and a plurality of flushing units disposed on both sides of the support portion in the first direction and configured to receive ink while flushing is performed, wherein the flushing determination unit is configured to:

determine, when the flushing determination unit determines to perform the flushing in the return path of the movement of the carriage, whether the flushing in the return path of the movement of the carriage is to be performed in the flushing unit or in a region not overlapping with the printing medium at the support portion, in accordance with a width of the printing medium; and set the return position based on the determination.

3. The printing apparatus according to claim 1, comprising: as a printing mode, a first mode in which a moving speed of the carriage is a first speed; and a second mode in which the moving speed of the carriage is a second speed that is different from the first speed, wherein the correspondence relationship includes: a first correspondence relationship when the moving speed of the carriage is the first speed, and a second correspondence relationship when the moving speed of the carriage is the second speed, and the flushing determination unit is configured to calculate the threshold value using the first correspondence relationship as the correspondence relationship when the printing mode is the first mode, and to calculate the threshold value using the second correspondence relationship as the correspondence relationship when the printing mode is the second mode.

4. The printing apparatus according to claim 1, wherein $Time_{elapse}$ indicating the temporary reciprocating movement time is expressed by the following equation (1), $$Time_{elapse} = \left( \frac{(\text{PASS WIDTH} - \text{ACCELERATION AND DECELERATION PRINTING WIDTH})}{(CR\ \text{SPEED})} + \text{ACCELERATION AND DECELERATION TIME} \right) \times 2 \quad (1)$$

wherein a moving speed of the carriage when the carriage performs printing at a constant speed is a CR speed, a distance that the carriage moves in a forward path of one reciprocating movement is a pass width, a sum of distances that the carriage moves accelerating or decelerating in the forward path of one reciprocating movement is an acceleration and deceleration printing width, and a sum of times during which the carriage is accelerated or decelerated in the forward path of one reciprocating movement is an acceleration and deceleration time, $Time_{thresh}$ indicating the threshold value at the environmental temperature T is expressed by the following equation (2), $$Time_{thresh} = Time_{ref0} + (Time_{ref1} - Time_{ref0}) \times \frac{T - Temp_{ref0}}{Temp_{ref1} - Temp_{ref0}} \quad (2)$$

wherein threshold values corresponding to $Temp_{ref0}$ indicating a first reference temperature and $Temp_{ref1}$ indicating a second reference temperature that are two predetermined different temperatures, are respectively defined as $Time_{ref0}$ indicating a first threshold value and $Time_{ref1}$ indicating a second threshold value.

5. The printing apparatus according to claim 1, wherein the $Time_{elapse}$ is expressed by the following equation (3)

$$Time_{elapse} = \left( \frac{\text{(PASS WIDTH–ACCELERATION AND DECELERATION PRINTING WIDTH)}}{\text{(CR SPEED)}} + \text{ACCELERATION AND DECELERATION TIME} \right) \times 2 + \text{(RELATIVE MOVEMENT TIME – DECLARATION TIME OF CURRENT PASS RETURN PATH – ACCELERATION TIME OF NEXT PASS FORWARD PATH)} \quad (3)$$

when a relative movement time, that is a time associated with a relative movement between the recording head and the printing medium in a second direction orthogonal to the first direction performed after ejection of the droplet from the recording head to the printing medium along with the reciprocating movement of the carriage is longer than the acceleration and deceleration time.

6. The printing apparatus according to claim 5, wherein the $Time_{elapse}$ is expressed by the following equation (4)

$$Time_{elapse} = \left( \frac{\text{(PASS WIDTH – ACCELERATION AND DECELERATION PRINTING WIDTH)}}{\text{(CR SPEED)}} + \text{ACCELERATION AND DECELERATION TIME} \right) \times 2 + \text{(RELATIVE MOVEMENT TIME – DECLARATION TIME OF CURRENT PASS RETURN PATH – ACCELERATION TIME OF NEXT PASS FORWARD PATH)} \quad (4)$$

when a wait time is provided between passes, where the wait time provided between a current pass forward path and a current pass return path is a first wait time, and the wait time provided between the current pass return path and a next pass forward path is a second wait time, and the relative movement time is longer than the second wait time, and the $Time_{elapse}$ is expressed by the following equation (5)

$$Time_{elapse} = \left( \frac{\text{(PASS WIDTH – ACCELERATION AND DECELERATION PRINTING WIDTH)}}{\text{(CR SPEED)}} + \text{ACCELERATION AND DECELERATION TIME} \right) \times 2 + \text{(RELATIVE MOVEMENT TIME – DECLARATION TIME OF CURRENT PASS RETURN PATH – ACCELERATION TIME OF NEXT PASS FORWARD PATH)} \quad (5)$$

when the relative movement time is equal to or less than the second wait time.

7. A printing apparatus comprising:

an ink jet-type recording head configured to eject a droplet from a nozzle to a printing medium;

a carriage configured to reciprocate in a first direction while supporting the recording head;

a thermometer configured to measure an environmental temperature in a vicinity of the nozzle;

a control unit configured to control the reciprocating movement of the carriage and ejection of the droplet from the nozzle;

a flushing determination unit configured to determine whether to perform flushing in a return path of the reciprocating movement of the carriage; and a storage unit configured to store a condition for a landing error of the droplet ejected from the nozzle to be equal to or less than a predetermined allowable value based on a preliminarily obtained correspondence relationship between a non-ejection distance that is a distance along which the droplet is not ejected from the nozzle and a temperature, wherein the flushing determination unit is configured to:

calculate, in one reciprocating movement of the carriage, based on print data to be printed in the one reciprocating movement, a temporary return position in the reciprocating movement of the carriage, a temporary reciprocating movement distance that is a distance of the one reciprocating movement of the carriage necessary when the carriage is returned at the temporary return position, and a third threshold value that is a longest non-ejection distance that satisfies the condition at the environmental temperature measured by the thermometer; and determine whether the temporary reciprocating movement distance exceeds the third threshold value, wherein when the temporary reciprocating movement distance exceeds the third threshold value, the flushing determination unit sets a position at which the distance of the one reciprocating movement becomes longer than the temporary reciprocating movement distance as a return position in the reciprocating movement of the carriage, and also determines to perform the flushing in the return path of the movement of the carriage.

8. A printing control method of a printing apparatus that includes:

an ink jet-type recording head configured to eject a droplet from a nozzle to a printing medium;

a carriage configured to reciprocate in a first direction while supporting the recording head;

a thermometer configured to measure an environmental temperature in a vicinity of the nozzle; and a control unit configured to control the reciprocating movement of the carriage and ejection of the droplet from the nozzle, the printing control method comprising:

determining whether to perform flushing in a return path of the reciprocating movement of the carriage; and storing a condition for a landing error of the droplet ejected from the nozzle to be equal to or less than a predetermined allowable value based on a preliminarily obtained correspondence relationship between a non-ejection time that is a time during which the droplet is not ejected from the nozzle and a temperature, wherein the determination includes calculating, in one reciprocating movement of the carriage, based on print data to be printed in the one reciprocating movement, a temporary return position in the reciprocating movement of the carriage, a temporary reciprocating movement time that is the one reciprocating movement time of the carriage necessary when the carriage is returned at the temporary return position, and a threshold value that is a longest non-ejection time that satisfies the condition at the environmental temperature measured by the thermometer, and also including determining whether the temporarily reciprocating movement time exceeds the threshold value, and when the temporarily reciprocating movement time exceeds the threshold value, setting a position at which the one reciprocating movement time becomes longer than the temporary reciprocating movement time as a return position in the reciprocating movement of the carriage, and also determining to perform flushing in the return path of the movement of the carriage.

* * * * *